US007516915B2

(12) United States Patent
Dumas et al.

(10) Patent No.: US 7,516,915 B2
(45) Date of Patent: Apr. 14, 2009

(54) DOUBLE DRIVING ROLL WINDING DEVICE FOR CONTINUOUS ROLLING MACHINE WITH CONTROLLED APPLICATION LOAD OF THE DRIVING ROLLS

(75) Inventors: Jean Louis Dumas, Guebwiller (FR); Bernard Muller, Drusenheim (FR)

(73) Assignee: Monomatic, Strasbourg (FR)

( * ) Notice: Subject to any disclaimer, the term of this patent is extended or adjusted under 35 U.S.C. 154(b) by 253 days.

(21) Appl. No.: 10/587,349

(22) PCT Filed: Jan. 31, 2005

(86) PCT No.: PCT/FR2005/000200

§ 371 (c)(1),
(2), (4) Date: Jul. 26, 2006

(87) PCT Pub. No.: WO2005/075327

PCT Pub. Date: Aug. 18, 2005

(65) Prior Publication Data

US 2007/0152095 A1 Jul. 5, 2007

(30) Foreign Application Priority Data

Feb. 2, 2004 (FR) ..... 04 00968

(51) Int. Cl.
*B65H 18/14* (2006.01)

(52) U.S. Cl. ..... 242/541.4; 242/541.6; 242/542.3; 242/547

(58) Field of Classification Search ..... 242/541.1, 242/541.4, 541.5, 541.6, 542.3, 547
See application file for complete search history.

(56) References Cited

U.S. PATENT DOCUMENTS

| | | | | |
|---|---|---|---|---|
| 2,355,318 | A | | 8/1944 | Moravek |
| 3,471,097 | A | * | 10/1969 | Phelps ..... 242/542.3 |
| 4,491,283 | A | * | 1/1985 | Pav et al. ..... 242/547 |
| 4,744,526 | A | | 5/1988 | Kremar |
| 5,370,327 | A | * | 12/1994 | Adamski ..... 242/541.6 |
| 5,393,008 | A | | 2/1995 | Kyytsoenen et al. |
| 5,544,841 | A | * | 8/1996 | Didier et al. ..... 242/541.1 |
| 5,560,566 | A | * | 10/1996 | Bagnato ..... 242/541.1 |
| 5,673,870 | A | | 10/1997 | Fielding et al. |
| 5,690,298 | A | | 11/1997 | Rueck |

(Continued)

FOREIGN PATENT DOCUMENTS

DE 197 37 709 A1 11/1998

(Continued)

*Primary Examiner*—William A Rivera
(74) *Attorney, Agent, or Firm*—Young & Thompson

(57) ABSTRACT

A continuous rolling machine for web materials includes two independent driving rolls (4 and 5) co-operating with a take-up reel (3A, 3B). A winding method with controlled application load of the driving rolls is also disclosed. At least one of the driving rolls of the winding device (2) is in contact with the take-up reel (3A, 3B), from the start of the phase for preparing a new reel (3A) until the finished reel has completely stopped, one (4) of the driving rolls being in contact with the reel soon after the start of the latter's (3A) formation and until the finished reel has completely stopped (3B), the other driving roll (5) being in contact with the reel from the start of the latter's (3B) formation until its release (3B), prior to connecting a new reel.

18 Claims, 3 Drawing Sheets

U.S. PATENT DOCUMENTS 5,931,406 A * 8/1999 Siebert ..... 242/541.4
5,967,449 A * 10/1999 Thomas et al. ..... 242/541.1
6,129,305 A * 10/2000 Moller et al. ..... 242/542.3
6,250,580 B1 * 6/2001 Madrzak et al. ..... 242/542.3
6,402,081 B1 * 6/2002 Rautakorpi et al. ..... 242/541.5
6,739,544 B2 * 5/2004 Yuuki et al. ..... 242/542.3
2004/0144879 A1 * 7/2004 Acciari ..... 242/542.3

FOREIGN PATENT DOCUMENTS

DE 199 16 783 A1 10/2000

* cited by examiner

DOUBLE DRIVING ROLL WINDING DEVICE FOR CONTINUOUS ROLLING MACHINE WITH CONTROLLED APPLICATION LOAD OF THE DRIVING ROLLS

FIELD OF THE INVENTION

The present invention relates to the field of machines for continuously rolling web material, in particular lightweight netting such as non-woven material, and has for its object a machine for this type of winding comprising a winding device with two drive rolls for such machines.

The invention also has for its object a process for winding with regulation of the force of application of the winding rolls to the reel, during different phases of building this latter.

DESCRIPTION OF THE RELATED ART

At present, most of the winders adapted for the production of this type of reel use a single drive roll, in combination with axial control of the reel. Because production takes place continuously, the finished reel being spaced from the drive roll to provide a space for a new winding core of the following reel, the loss of contact between the drive roll and the completed reel can have the result of a decrease of the quality of winding, as well as variations of the tension in the netting.

However, the quality of regulation of the development of the force of application between the reel and the drive roll is essential to satisfy criteria of compactness of the reel, namely hardness and optimum shape, hence the importance of the instruments and principals used.

SUMMARY OF THE INVENTION

The present invention has for its object to overcome these drawbacks by proposing a winding device for continuous winding machines of web material, in particular lightweight netting, such as non-woven materials, with two drive rolls, and a process for winding with regulation of the force of application of said drive rolls, permitting respecting the requirements of winding.

To this end, the winding device for continuous winding machines of web material, and in particular lightweight netting, such as nonwoven materials, comprising a support frame for said winding and for the reel to be wound, which is essentially constituted by two independent drive rolls coacting with a winding reel, this reel being movable between a beginning winding position and an end winding position, by means of movable carriages, connected to linear actuators and guided on the frame, is characterized in that at least one of the drive rolls of the winding device is in contact with the reel from the beginning of the phase of preparing a new reel until total stopping of the completed reel, one of the drive rolls being in contact with the reel a little after the beginning of formation of this latter and until total stopping of the completed reel and being provided with means for continuous application against the reel and for continuous movement with the reel, the other drive roll being mounted on a device comprising a means for regulating the force of application against the reel and being in contact with the reel from the beginning of formation of this latter until the time of its disengagement, before connecting a new reel.

BRIEF DESCRIPTION OF THE SEVERAL VIEWS OF THE DRAWINGS

The invention will be better understood from the following description, which relates to a preferred embodiment, given by way of non-limiting example, and explained with reference to the accompanying schematic drawings, in which.

DETAILED DESCRIPTION OF THE PREFERRED EMBODIMENTS

Figure 1:
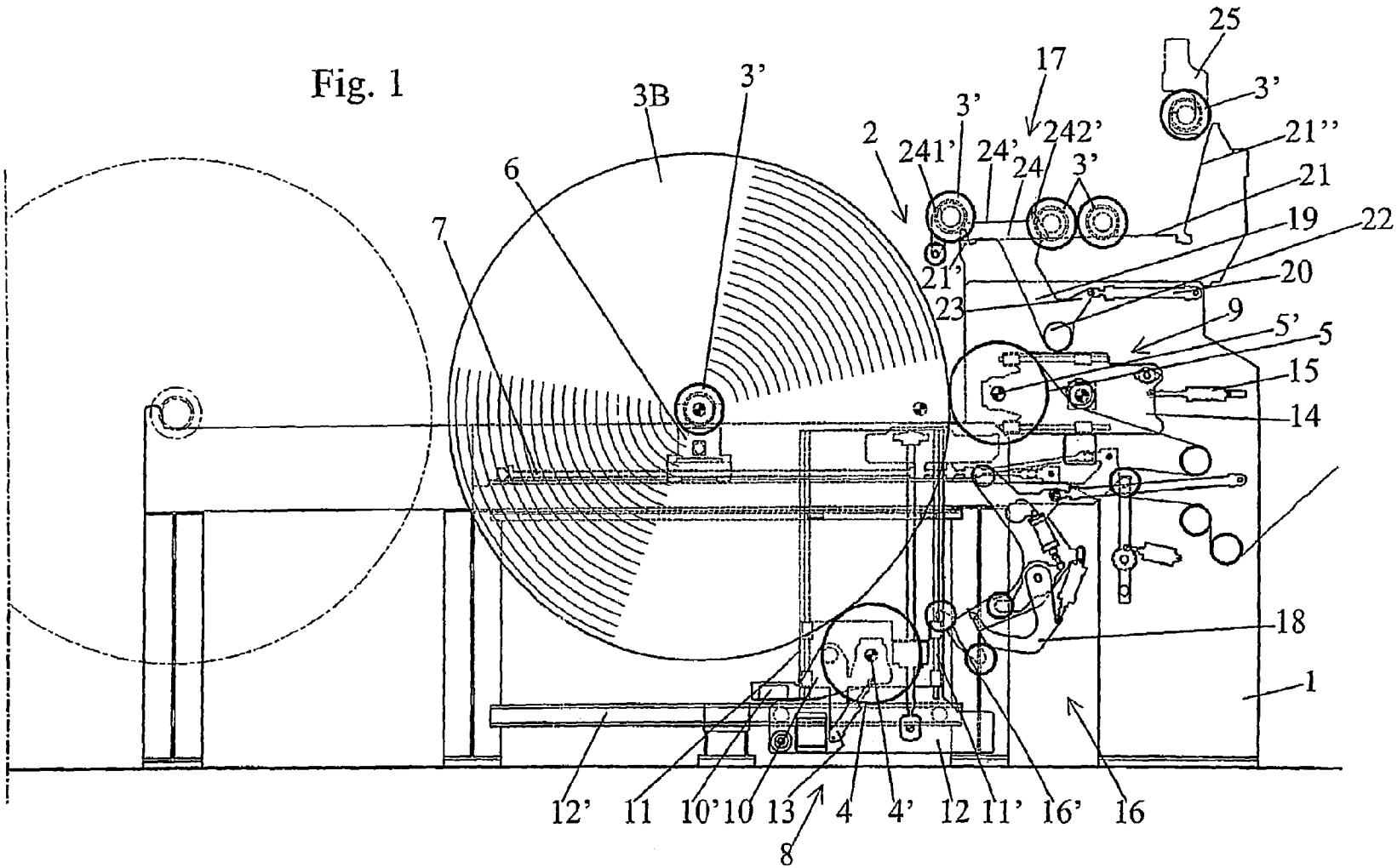
FIG. 1 is a side elevational view in cross-section showing the winding device according to the invention, in the position of forming a reel.
Figure 2:
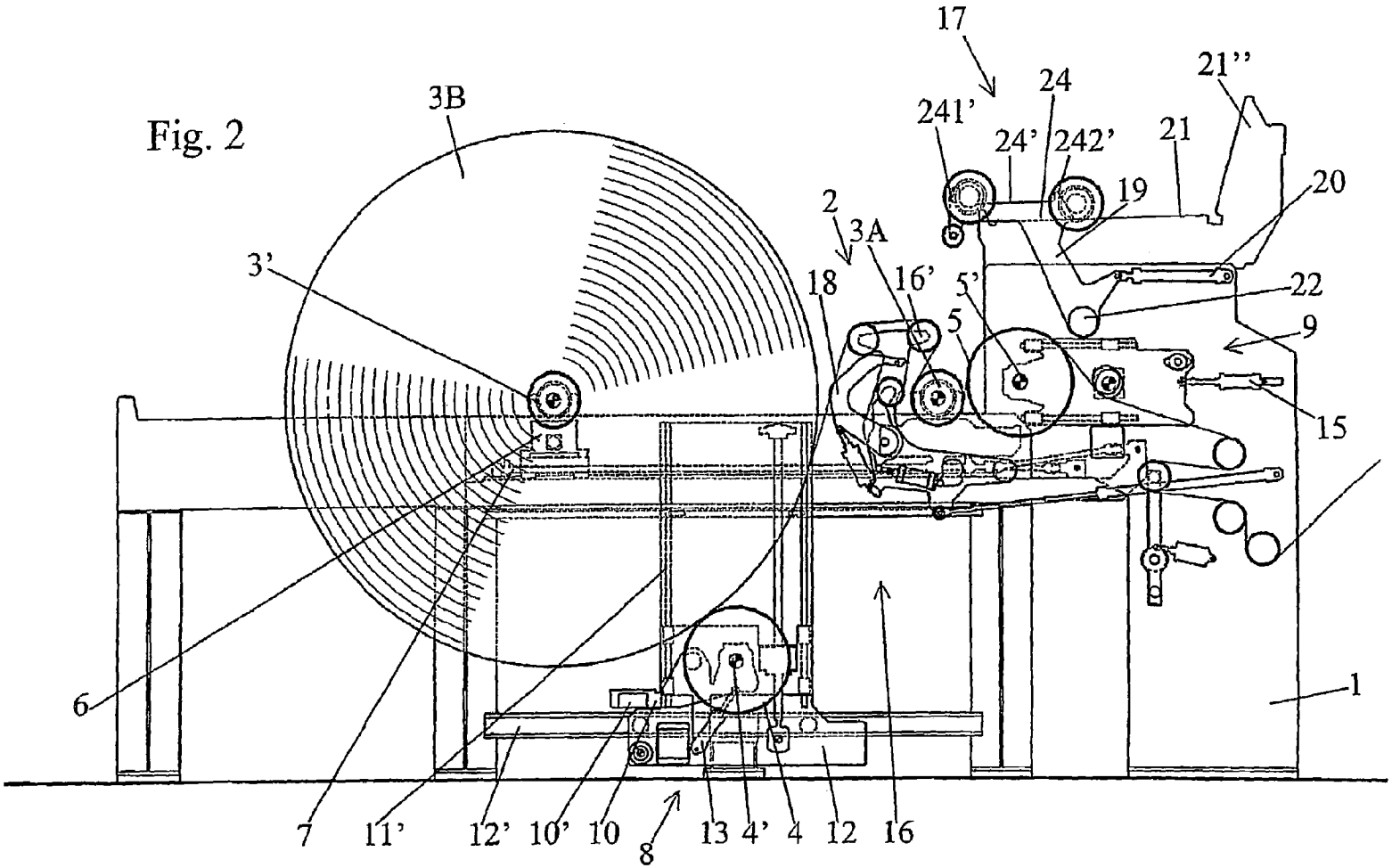
FIG. 2 is a view similar to that of FIG. 1 showing the device in the position of connecting a web of material to a new core for winding reels.
Figure 3:
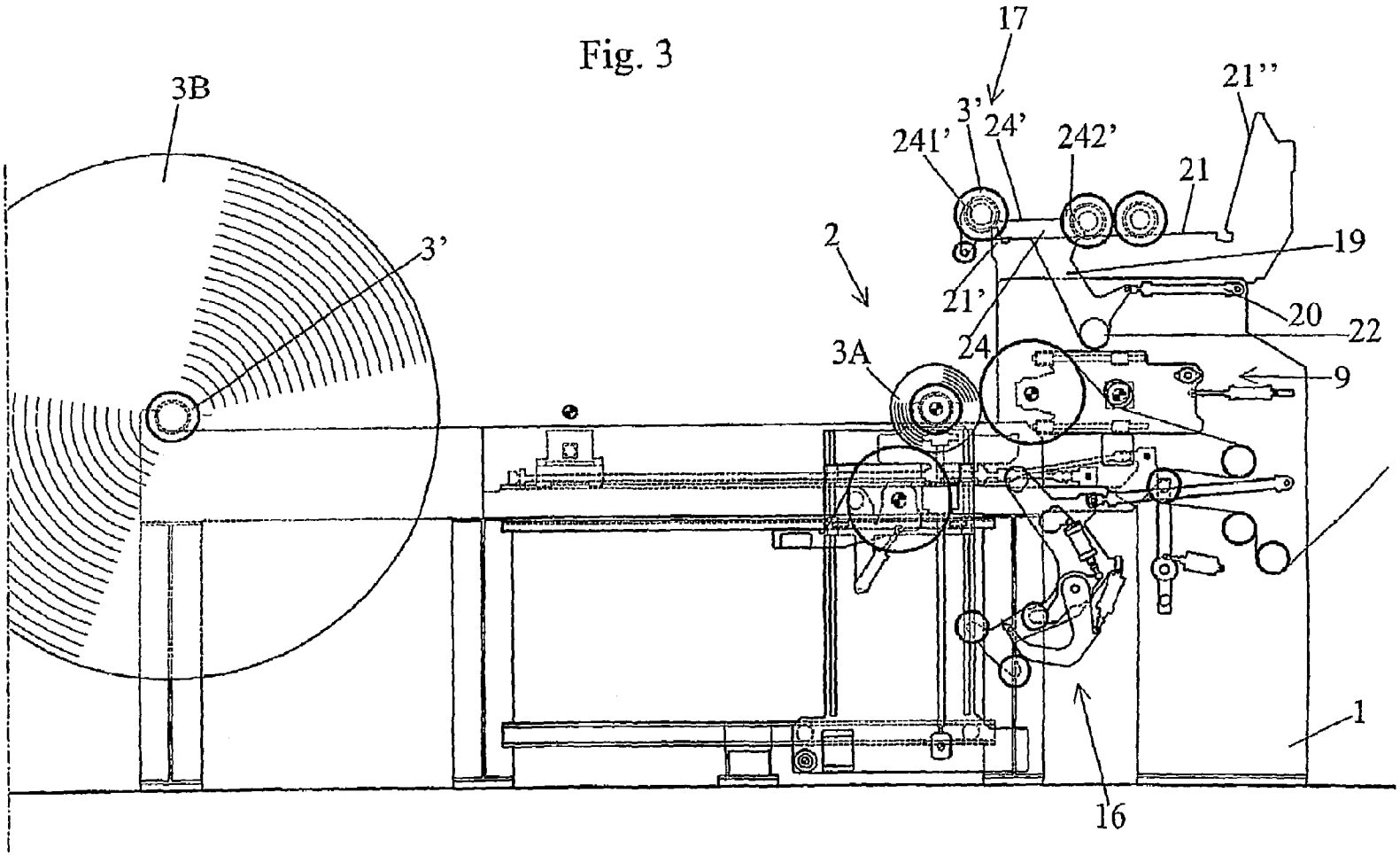
FIG. 3 is a view similar to FIGS. 1 and 2, in which the full reel is ready to be removed for storage or for its mounting on a machine for downstream use, the new reel being in the phase of winding under the conjoint action of the two drive rolls.

FIGS. 1 to 3 of the accompanying drawings show a continuous winding machine for web materials, in particular lightweight netting, such as non-woven material, which is essentially constituted by a frame 1, on which is mounted a winding device 2 for a reel to be wound 3A, 3B, also mounted on said frame 1, this winding device 2 being essentially constituted by two independent drive rolls 4 and 5 coacting with a reel to be wound 3A, 3B. The reel is movable, between the beginning winding position 3A and an end winding position 3B, by means of movable carriages 6, connected to linear actuators 7 and guided on the frame 1. These linear actuators 7 can be of any known type, namely in the form of mechanical, hydraulic or pneumatic jacks, ballbearing screws, or in the form of rack and pinion assemblies or the like.

The machines of this type are, in a known manner, generally provided with several pairs of carriages 6, namely at least two pairs of carriages 6 guided in parallel on the frame 1, such that two carriages 6 which are free from a completed reel 3B can be brought, first to a standby position, then to a position of mounting a new core 3' whilst the other pair of carriages 6 serves to support a reel 3 in the course of formation.

According to the invention, at least one of the drive rolls of the winding device 2 is in contact with the reel 3A, 3B, from the beginning of the phase of preparation of a new reel 3A until total stopping of the completed reel 3B, one, 4, of the drive rolls being in contact with the reel a little after the beginning of the formation of the latter 3A and until total stopping of the completed reel 3B and being provided with a means 8 for continuous application against the reel and for continuous movement with the reel, the other drive roll 5 being mounted on a device 9 comprising a means for regulating the application of force against the reel 3A and being in contact with the reel from the beginning of the formation of this latter 3A until the time of its disengagement 3B, before connecting a new reel.

The drive rolls 4 and 5 are preferably driven, in known manner, by means of drive motors 4' and 5' of adjustable speed by means of a control computer of the winding machine (not shown).

There is known from U.S. Pat. No. 3,057,572 a process in which the winding tension, which is to say the tension of the web and hence the hardness or compactness of the reel, is controlled by using a speed differential between the two drive rolls, by action on the speed of rotation of the respective drive motors.

The means 8 for continuous application of the drive roll 4 against the reel 3A, 3B is essentially constituted by pivotal levers 10 for supporting the ends of the drive roll 4, mounted on a vertically movable carriage 11 guided on a frame 12 with horizontal movement parallel to the movement of the reel 3A, 3B. The pivoting levers 10 are preferably connected, at the end opposite to that of mounting the drive roll 4, to a balancing counterweight 10' and are actuated pivotably by means of at least one jack 13. The jack or jacks 13 act either on the counterweight 10' or directly on the levers 10. Thanks to this counterweight device, the drive roll 4 can very easily be applied against the reel 3A, 3B under formation, this with an adjustable force being able to be obtained by means of jacks 13 of small cross-section.

The vertically movable carriage 11 is preferably guided in vertical movement on the frame 12 for horizontal movement by means of guide and movement means 11', such as electromechanical, hydraulic or pneumatic linear actuators. This mounting of the carriage 11 on the movable frame 12 permits following, with the drive roll 4, the growth in diameter of the reel 3A, 3B, by vertical movement of said roll 4 between the high beginning position of winding a new reel, and a low end position of completed winding of the finished reel 3B.

The movable frame 12 for supporting the carriage 11 for vertical movement of the drive roll 4, is guided in horizontal movement on rails 12' of the frame 1 and is driven for this movement by means, either of a motor reducer assembly engaging with a rack parallel to the guide rail 12', or by means of an electromechanical, hydraulic or pneumatic linear actuator. These drive means are completely known to those skilled in the art and will not be described in greater detail.

The drive roll 5 has an axis substantially aligned at the same plane as that of the winding core 3' of the reel to be wound 3A, 3B and is mounted on a device 9 for regulation for force of application, which is essentially constituted by a movable carriage 14 guided on the frame 1 with the possibility of a reciprocating movement by means of at least one jack 15 of regulated pressure, whose movement is controlled by means of the control computer of the winding machine. Thus, the drive roll 5 can be continuously in bearing engagement against the growing reel, from the beginning of winding a new web on a new winding core 3B (FIG. 3).

Moreover, in known manner, this drive roll 5 is driven in rotation by means of its own motor 5' coacting with an assembly of pulleys and belts or by means of a series of engaging pinions, or the like.

The jack or jacks 13 for pivotally actuating the drive roll 4 and the jack or jacks 15 for moving the movable carriage 14 carrying the drive roll 5, are preferably connected groupwise, each dedicated to a drive roll, to a means for programmably regulating pressure as a function of the selected winding regime and taking account of the material to be wound and the dimensions of the reel 3A, 3B, these pressure regulating means (not shown) being themselves controlled by means of the programmable control computer of the winding machine. Thus, during all the phase of winding a reel 3A, 3B, the drive rolls 4 and 5 are held in contact with said reel 3A, 3B with a force of application regulated by action on the working pressure of the jacks 13 and 15.

The invention also has for its object a process for winding with regulation of the force of application of the winding rolls 4 and 5 against the reel 3A, 3B, characterized in that, during the different phases of forming this latter, it consists essentially in successively and/or simultaneously applying said drive rolls 4, 5 with a regulated force of application, against the reel 3A, 3B, with relative movement of said drive rolls 4 and 5 relative to the reel by means of support means using guiding and movement devices, as well as devices for applying said drive rolls 4 and 5 against the reel 3A, 3B.

According to another characteristic of the invention not shown in the accompanying drawings, the movements of the vertically movable carriage 11 of the drive roll 4, of the movable carriage 12 for horizontal movement of the vertically movable carriage 11 and of the movable carriage 14 for supporting the drive roll 5, are controlled by means of position detectors coacting directly with the movement means of these different carriages and frames. Thus, it is possible to follow precisely the position of the drive rolls 4 and 5 and to act on the force of application of these latter against the reel 3A, 3B to be wound.

To this end, during winding a reel 3A, 3B, the diameter of this latter increases, such that the drive roll 5 of the movable carriage 14 of the device 9 for regulating the pressure of said drive roll 5, moves against the action of the jack 15 with a regulated force of application, such that the assembly of the carriage 14 is moved in a direction away from the reel 3A, 3B until it reaches a rear position read by a position detector. It follows that in this rear position, the movement of the reel 3A, 3B in a direction opposite to that of the drive roll 5 is controlled by actuation of the movable carriages 6 for supporting the reel 3A, 3B by means of linear actuators 7. The consecutive movement of the reel takes place simultaneously with the movement of the same amplitude of the drive roll, due to the fact that this latter is applied against said reel under regulated pressure, these combined movements being interrupted upon reaching the front position of the drive roll 5, this position being read by a detector, the force of application applied by the jack 15 being regulated.

The movement of the drive roll 4, which follows the reel 3A, 3B during formation by bearing substantially near the lower portion of the reel 3A, 3B, is controlled in a manner identical to that of the drive wheel 5 as to its application against the reel 3A, 3B. This drive roll 4 being mounted on pivotable levers 10 of the vertically movable carriage 11 with mechanical balancing by means of balancing counterweights 10', the pneumatic regulation of the force of application of said roll 4 against the reel 3A, 3B can be carried out in a very sensitive way.

Thus, during all the phase of production of the reel 3A, 3B, the drive rolls 4 and 5 move progressively, as its diameter increases, whilst remaining continuously in contact with said reel 3A, 3B with a regulated force of application. Thus, the force of application of the drive rolls 4 and 5 against the reel is a real regulation of the force and not, as exists at present in embodiments of winder of the existing type, the result of a pilot program for the position of the axis of the reel relative to the drive roll. In such case, this axis of the reel, which is spaced from the rolls by taking into account a program for computing the theoretical diameter of the reel, which takes account of the speed of the web to be wound, of the thickness of this web and of the geometry of the rolls.

As can also be seen from FIGS. 1 to 3 of the accompanying drawings, the winding machine is moreover provided, adjacent the device 9 for regulating the force of application of the drive roll 5, with an assembly for connection and a means 17 for emplacing a new winding core.

The connection assembly 16 is of known type in the field of winding web material on cores or mandrels and essentially comprises an incurved arm provided with at least one return roll 16' for application of a strip on a new core 3', as well as a means 18 for cutting on the fly or for transverse cutting, also of known type in this field (FIG. 2).

The means 17 for emplacing a new winding core 3' is preferably in the form of a pivotable cradle formed by two elbowed arms 19 controlled in synchronism each by a jack 20 and extending on opposite sides of a table 21 for preliminary deposit and standby of empty winding cores 3'. Each elbowed arm 19 is mounted pivotably about an axle 22, on the frame 1 of the winding machine and is provided on the one hand with a wing 23 for connection to the corresponding jack 20 and, on the other hand, with a wing 24 having a surface 24' for supporting an empty winding core 3' and extending, in the standby position before emplacement of a new core 3', parallel to and above the table 21 for preliminary deposit and standby of empty winding drums 3'. The surface 24' of wing 24 is delimited, at its end turned toward the movable carriages 6 for supporting the reels 3 to be wound, by a bearing 241' for receiving the axle of the core 3' and, on the opposite side of this bearing 241', with an abutment 242' prolonged externally of the surface 24' by an inclined plane forming a stop for the axle of a new core 3' located on the preliminary deposit table 21.

The preliminary deposit table 21 preferably has a surface for receiving the axles of new cores 3' slightly inclined relative to the horizontal, in the direction of the movable carriages 6 for supporting the reels 3A, 3B to be wound and delimited, in this direction, by a stop abutment 21', and at its rear end relative to this direction, by an abutment 21" inclined relative to the vertical and forming a stop for the arrival of new empty cores 3'.

Thus, the new empty cores 3', which are brought by means of a handling device with hooks 25, comes into abutment against the inclined abutment 21" and are deposited by means of said device 25 on the table 21 and roll, along their axle, on the surface of this latter in the direction of the inclined plane prolonging the abutment 242' of the surface 24' of the wing 24 of the elbowed arm 19. As a result, to emplace a new empty core 3', so as to begin a new phase of winding, according to FIG. 2, the elbowed arms 19 are pivoted about their axle 22 so as to bring the new core 3' disposed in their bearing 241' onto new empty movable carriages 6. In the course of this pivoting, the new cores 3' on the table 21 move on this latter up to the rear abutment 21'.

During return in position of the elbowed arms 19, after depositing a new core 3', the abutment 242' provided at the rear end of the surface 24' of each wing 24, passes below the axle of the new core 3' located farthest in front on the table 21 and bearing against the abutment 21' and enters into contact with the axle of the new core 3' that follows, for pushing it on said table 21 in the direction of its inclined abutment 21". With this same movement, the first new core 3' engages on the surface 24' of each wing 24 of the elbowed levers 19, then rolls in the direction of the bearing 241' in which it engages by its axle, the surface 24' being, in the rest position, slightly inclined in the direction said bearing 241'.

As soon as the diameter of the reel 3A has reached a threshold value defined as a function of the final diameter of the reel to be obtained, or of a length of the web to be wound on said reel, the preparation phase begins. To this end, the drive roll 5 retreats to its rear position, following the actuation of the movable carriage 14 by means of the jack 15 (FIG. 2). Then the reel 3B is moved to its end winding position, then it slows and stops after connection, the drive roll 4 follows this horizontal movement while being held with constant force of application against said reel.

The connection of a web on a new core 3' at the end of winding a reel 3B takes place, in known manner, with synchronized speed by bringing the unwinding web, by means of the connection assembly 13 in contact with the periphery of the new core 3', this new core 3' being rotated, also in a known manner, by means of the axial drive means provided on the carriages or by means of an independent drive motor.

Simultaneously with the application of the unwinding web against the new core 3', this web is cut, such that the end of the web can wind about the reel 3B that has completed winding and that the cut end winds up on the new core 3' by being pinched between this latter and the drive roll 5, which is then applied against the new core 3'. After the connection of the beginning of the web, the connection assembly 16 returns to its rest position, shown in FIGS. 1 and 3.

As soon as cutting takes place, the drive roll 4 slows, simultaneously with the axial drive, the completed reel 3B, until complete stopping of this latter, which is then removed toward the end of the frame 1 opposite that carrying the drive roll 5.

The axial drive motor of the reel is thus used for the synchronization of the new core during connection and for stopping the completed reel 3B.

After connection and stopping of the completed reel 3B, the drive reel 4 is returned to its initial position shown in FIG. 3, in which it comes back into engagement against the new reel 3A. The corresponding movement is carried out by means of the movable frame 12 and of the vertically movable carriage 11. Simultaneously, the completed reel 3B can be ejected and put to downstream use or stored.

Thanks to the invention, it is possible to provide a continuous winding machine for web materials, in particular lightweight netting such as non-woven materials, permitting winding by means of two drive rollers at a speed that can be different, at least one of these drive rolls being applied continuously against the forming reel under force of application that is precisely regulated, such that the obtained reels can be perfectly calibrated, both as to their hardness and as to their compactness.

Of course, the invention is not limited to the embodiment described and shown in the accompanying drawings. Modifications remain possible, particularly as to the construction of the various elements or by substitution of technical equivalents, without thereby departing from the scope of protection of the invention.

The invention claimed is:

1. A continuous winding machine for web materials, comprising:

a frame (1);

a reel to be wound (3A, 3B), said reel (3A, 3B) mounted on the frame (1); and a device (2), mounted on the frame (1), for winding the reel to be wound (3A, 3B), the winding device (2) being essentially constituted by two independent drive rolls (4, 5) coacting with the reel to be wound (3A, 3B), movable between a beginning winding position and an end winding position by means of movable carriages (6), the movable carriages (6) connected to linear actuators (7) and guided on the frame (1), wherein, at least one of the drive rolls of the winding device (2) is in contact with the reel (3A, 3B) from a beginning of a preparation phase of a new reel (3A) to a total stoppage of a completed reel (3B), a first (4) of the drive rolls is in contact with the new reel (3A) soon after a beginning of a formation of the new reel (3A) and until the total stoppage of the completed reel (3B) and is provided with a means (8) for continuous application against the reel (3A, 3B) and for continuous movement with the reel (3A, 3B), vertically and horizontally, comprising a vertically movable carriage (11) guided on a frame (12) for horizontal movement parallel to the movement of the reel (3A, 3B), and the second of the drive rolls (5) is mounted on a device (9) for adjusting a force of application against the new reel (3A) and is in contact with the reel from the beginning of the formation of the new reel (3A) to a time of disengagement of the completed reel (3B), before connecting a new reel.

2. The machine according to claim 1, wherein the means (8) for continuous application of the first drive roll (4) against the reel (3A, 3B) is provided with pivotal levers (10) for supporting ends of the first drive roll (4) mounted on the vertically movable carriage (11).

3. The machine according to claim 2, wherein, the pivotal levers (10) have a first end for mounting the first drive roll (4) and a second end opposite the first end, and the pivotal levers (10) are connected, at the second end to a balancing counterweight (10') and are actuated pivotally by means of at least one jack (13).

4. The machine according to claim 3, wherein the at least one jack (13) for pivotally actuating the first drive roll (4) and another at least one jack (15) for moving a movable carriage (14) for carrying the second drive roll (5) are connected group-wise to a means for regulating a programmable pressure as a function of i) selected winding regimes, ii) the web materials to be wound, and iii) the dimensions of the reel (3A, 3B), the pressure regulating means controlled by means of a programmable control computer of the winding machine.

5. The machine according to claim 2, wherein the vertically movable carriage (11) is guided in vertical movement on the horizontally movable carriage (12) by a guidance and movement means (11').

6. The machine according to claim 5, wherein the guidance and movement means (11') is one of mechanical, hydraulic or pneumatic linear actuators.

7. The machine according to claim 2, wherein the movable frame (12) for supporting the vertically movable carriage (11) of the drive roll (4) is guided in horizontal movement on rails (12') of the frame (1) and is driven in this movement by means of a motor reducer assembly engaging with a rack parallel to the guide rail (12').

8. The machine according to claim 2, wherein movements i) of the vertically movable carriage (11) of the first drive roll (4), ii) of the movable carriage (12) for horizontal movement of the vertically movable carriage (11), and iii) of the movable carriage (14) for supporting the second drive roll (5) are controlled by means of position detectors coacting directly with each of a movement means of the vertically movable carriage (11), a movement means of the horizontally movable carriage (12), a movement means of the movable carriage (14) for supporting the second drive roll (5).

9. The machine according to claim 2, wherein the movable frame (12) for supporting the vertically movable carriage (11) of the drive roll (4) is guided in horizontal movement on rails (12') of the frame (1) and is driven in this movement by means of a linear actuator.

10. The machine according to claim 1, wherein the second drive roll (5) has an axis substantially aligned in a same plane as a winding core (3') of the reel to be wound (3A, 3B), and is mounted on the device (9) for adjusting the force of application, and wherein the device (9) for adjusting the force of application is essentially constituted by a movable carriage (14) guided on the frame (1) and is capable of a reciprocal movement by means of at least one jack (15) of regulated pressure, a movement of the at least one jack (15) being controlled by means of a control computer of the winding machine.

11. The machine according to claim 1, wherein, a connection assembly (16) and a means (17) for supplying and emplacing a new winding core is provided adjacent the device (9) for adjusting the force of application.

12. The machine according to claim 11, wherein the means (17) for supplying and for emplacing a new empty winding core (3') is present in the form of a pivotal cradle formed by two elbowed arms (19) each controlled in synchronism by a jack (20) and extending on opposite sides of a table (21) for both i) preliminary receipt of a plurality of empty winding cores (3') and ii) holding the plurality of empty winding cores (3') in standby.

13. The machine according to claim 12, wherein each elbowed arm (19) i) is pivotally mounted about an axle (22) on the frame (1) of the winding machine, and ii) is provided with a first wing (23) at a first end for connection to the corresponding jack (20) and with a second wing, (24) at a second end, having a support surface (24') for the empty winding core (3'), and extending, in a standby position before emplacement of the empty winding core (3'), parallel to and above the table (21) for preliminarily receiving and holding in standby the plurality of empty winding cores (3').

14. The machine according to claim 13, wherein the support surface (24') of the second wing (24) is delimited by, at an end of the second wing (24) turned toward the movable carriages (6) for supporting the reel to be wound (3A, 3B), a bearing (241') for receiving an axle of the empty winding core (3'), and further by, on a side of the second wing (24) opposite the bearing (241'), an abutment (242'), the abutment (242') prolonged, externally of the surface (24'), by an inclined plane forming a stop for the axle of the empty winding core (3') located on the table (21).

15. The machine according to claim 12, wherein the table (21) has a reception surface for the axle of the new core (3'), the reception surface inclined relative to the horizontal in a direction of the movable carriages (6) and delimited in the direction of the movable carriages (6) by a stop abutment (21'), and further delimited by, at a rear end of the reception surface relative to the direction of the movable carriages (6), an abutment (21") inclined relative to the vertical and forming a stop for the arrival of the empty empty winding core (3').

16. The machine according to claim 1, wherein the web materials are lightweight netting.

17. The machine according to claim 16, wherein the lightweight netting are non-woven materials.

18. A winding process for winding rolls (4, 5) on a reel (3A, 3B) on a winding machine according to claim 1, comprising the further step of:

applying successive and/or simultaneously said drive rolls (4, 5) with a regulated force of application against the reel (3A, 3B), with relative movement of said drive rolls (4, 5) relative to the reel.

* * * * *